US009383718B2

(12) United States Patent
Kozushi

(10) Patent No.: US 9,383,718 B2
(45) Date of Patent: Jul. 5, 2016

(54) FRAME BODY STRUCTURE, APPARATUS FRAME BODY, AND IMAGE FORMING APPARATUS

(71) Applicant: FUJI XEROX CO., LTD., Tokyo (JP)

(72) Inventor: Takehiro Kozushi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/463,146

(22) Filed: Aug. 19, 2014

(65) Prior Publication Data

US 2015/0248104 A1 Sep. 3, 2015

(30) Foreign Application Priority Data

Mar. 3, 2014 (JP) ..... 2014-040426

(51) Int. Cl.
*G03G 15/00* (2006.01)
*G03G 21/16* (2006.01)

(52) U.S. Cl.
CPC ..... *G03G 21/1619* (2013.01); *G03G 21/1647* (2013.01); *G03G 2215/0132* (2013.01)

(58) Field of Classification Search
CPC ..... G03G 15/00; G03G 15/01
USPC ..... 399/107
See application file for complete search history.

(56) References Cited

U.S. PATENT DOCUMENTS

2010/0308533 A1* 12/2010 Masuda et al. ..... 271/264
2013/0129380 A1* 5/2013 Matsuno ..... G03G 15/00 399/107

FOREIGN PATENT DOCUMENTS

JP A-9-146321 6/1997

* cited by examiner

*Primary Examiner* — Clayton E LaBalle
*Assistant Examiner* — Fang-Chi Chang
(74) *Attorney, Agent, or Firm* — Oliff PLC

(57) ABSTRACT

Provided is a frame body structure including a first member that includes a side end bent in a direction separated from a floor when the frame body structure is placed on the floor and is provided along the floor, and a second member that includes a lower end contacting the side end, is raised over the side end, connects between the lower end and the side end, and includes a protrusion protruding immediately above an upper end edge of the side end, wherein the first member and the second member are combined with each other.

6 Claims, 9 Drawing Sheets

FRAME BODY STRUCTURE, APPARATUS FRAME BODY, AND IMAGE FORMING APPARATUS

CROSS-REFERENCE TO RELATED APPLICATIONS

This application is based on and claims priority under 35 USC 119 from Japanese Patent Application No. 2014-040426 filed Mar. 3, 2014.

BACKGROUND

Technical Field

The present invention relates to a frame body structure, an apparatus frame body, and an image forming apparatus.

SUMMARY

According to an aspect of the invention, there is provided a frame body structure including:

a first member that includes a side end bent in a direction separated from a floor when the frame body structure is placed on the floor and is provided along the floor; and a second member that includes a lower end contacting the side end, is raised over the side end, connects between the lower end and the side end, and includes a protrusion protruding immediately above an upper end edge of the side end, wherein the first member and the second member are combined with each other.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described.

Figure 1:
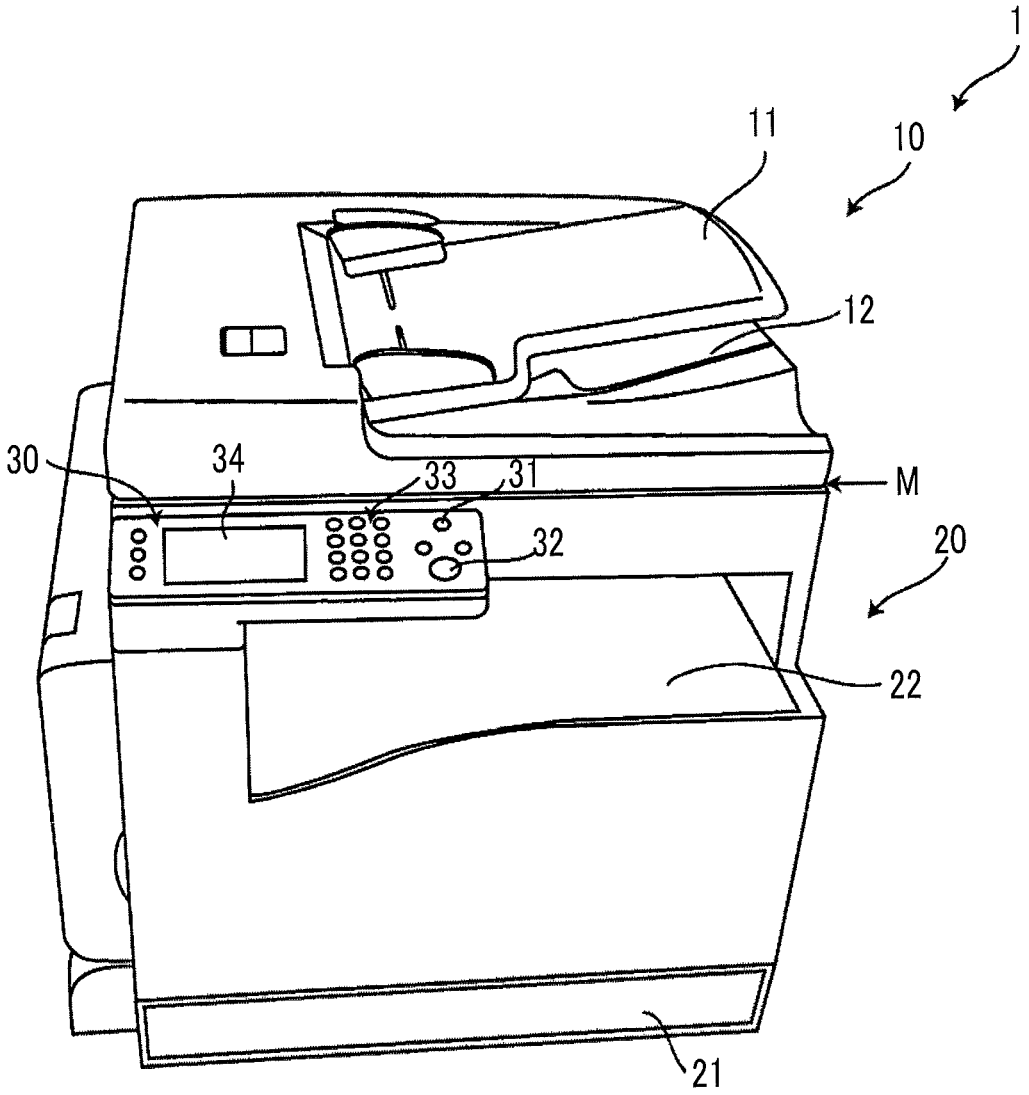
FIG. 1 is an exterior perspective view of an image forming apparatus according to an exemplary embodiment of the present invention.

FIG. 1 is an exterior perspective view of an image forming apparatus according to an exemplary embodiment of the invention.

An image forming apparatus 1 includes a scanner 10 and a printer 20.

The scanner 10 is a device which reads an image drawn on a document so as to generate an image signal. In addition, the printer 20 prints and outputs the image based on the image signal on a sheet.

The scanner 10 is provided with a document tray 11 and a document discharge tray 12. When a start button 32 is pressed in a state in which documents are placed on the document tray 11 in a stacked manner, the documents are sequentially fed one by one so as to be read, and are discharged onto the document discharge tray 12. In addition, a hinge (not illustrated) which extends in a horizontal direction is provided inside the scanner 10, and thus an upper portion of an arrow M may be lifted to open. A transparent glass plate 13 (refer to FIG. 2) spreads directly under the arrow M. When a single document is placed downwardly on the transparent glass plate 13, and the start button 32 is pressed in a state in which the upper portion of the arrow M is closed, the document on the transparent glass plate 13 may be read.

In addition, the printer 20 is a device which sequentially extracts paper sheets stacked in a paper tray 21 one by one, and prints an image based on an image signal on the extracted paper sheet. The paper sheet on which the image is printed is discharged onto a paper discharge tray 22. In the present exemplary embodiment, the printer 20 is a printer which prints and outputs an image on a paper sheet in a so-called electrophotographic method.

In addition, the image forming apparatus 1 includes a user interface (UI) 30. The UI 30 is provided with a power button 31, the start button 32, plural press buttons 33, and a touch panel type display screen 34. The UI 30 is operated, and thus various instructions such as an instruction for the number of prints or an instruction for starting an operation are performed. Further, the display screen 34 displays a state of the apparatus or various press buttons. The press buttons 34 displayed on the display screen 34 are targets of operations.

Figure 2:
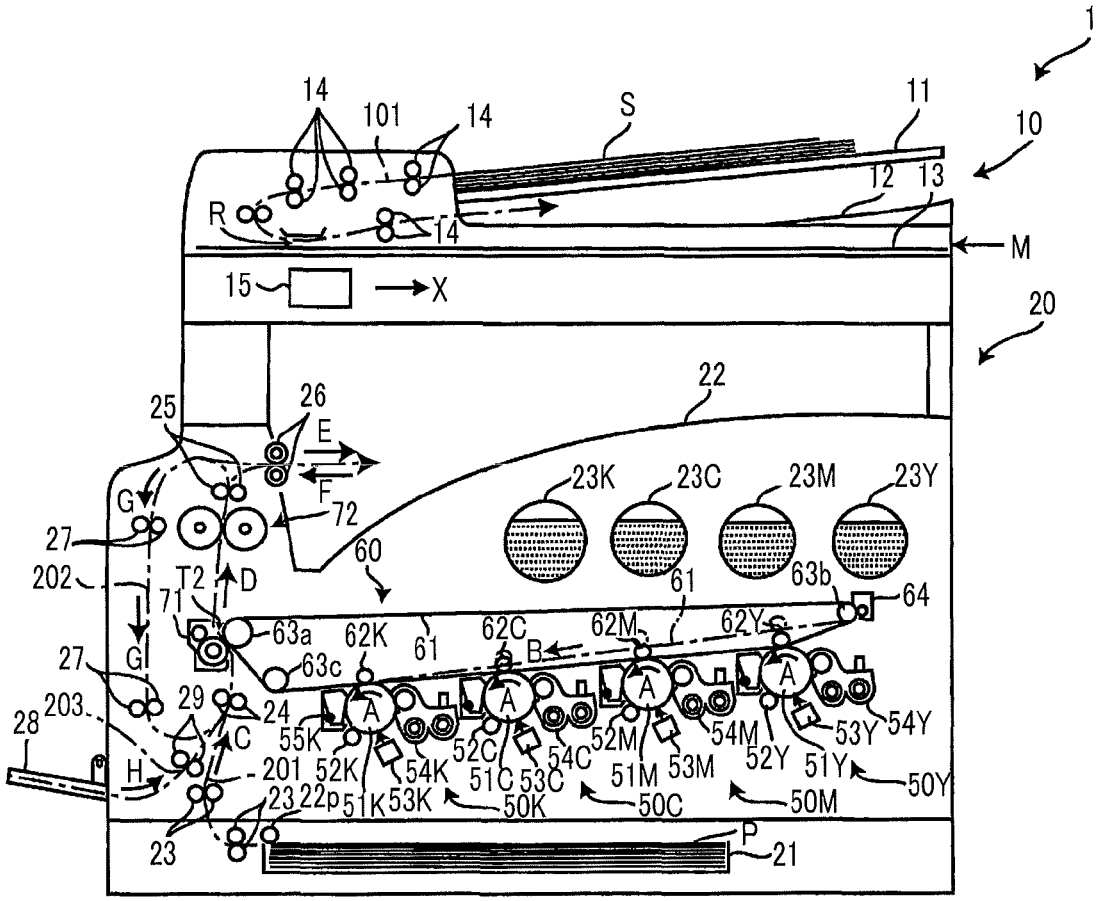
FIG. 2 is a schematic diagram illustrating an internal configuration of the image forming apparatus whose exterior is illustrated in FIG. 1.

FIG. 2 is a schematic diagram illustrating an internal configuration of the image forming apparatus whose exterior is illustrated in FIG. 1.

When the start button 32 (refer to FIG. 1) is pressed, documents S placed on the document tray 11 of the scanner 10 are fed one by one so as to be transported along a transport path 101 by transport rolls 14, and are discharged onto the document discharge tray 12 after passing through a reading position R which is in contact with the transparent glass plate 13 in the course of the transport. In addition, when the document S passes through the reading position R, an image recorded on the document S is read by a reader 15 which faces and stops at the reading position R, so as to be converted into an image signal.

Further, a paper sheet is placed downwardly on the transparent glass plate 13 in a state in which the upper portion of the arrow M is opened, and the start button 32 is pressed in a state in which the upper portion is closed. At this time, the reader 15 is moved in an arrow x direction, and reads the document on the transparent glass plate 13 so as to perform conversion into an image signal.

The printer 20 includes four image forming units 50Y, 50M, 50C and 50K which are arranged in a line approximately transversely. The image forming units 50Y, 50M, 50C and 50K are image forming units which form toner images by respectively using color toner including yellow (Y), magenta (M), cyan (C), and black (K). Here, in description common to the image forming units 50Y, 50M, 50C and 50K, the reference signs Y, M, C and K for differentiating colors of toner from each other are omitted, and the image forming unit(s) 50 is (are) denoted. This is also the same for constituent elements other than the image forming units.

A photoconductor 51 is provided in each of the image forming units 50. The photoconductor 51 is rotated in an arrow A direction by a driving force, and, in this state, an electrostatic latent image is formed on a surface thereof, and further a toner image is formed through development.

A charger 52, an exposure device 53, a developer device 54, a primary transfer device 62, and a cleaner 55 are provided in the periphery of the photoconductor 51 constituting each of the image forming units 50. Here, an intermediate transfer belt 61 described later is located at a position to be interposed between the primary transfer device 62 and the photoconductor 51. The primary transfer device 62 is not included in the image forming unit 50, and is included in an intermediate transfer unit 60 described later.

The charger 52 uniformly charges the surface of the photoconductor 51.

The exposure device 53 irradiates the uniformly charged photoconductor 51 with exposure light which is modulated based on an image signal, so as to form an electrostatic latent image on the photoconductor 51.

The developing device 54 develops the electrostatic latent image formed on the photoconductor 51 with toner having a color corresponding to each of the image forming units 50Y, 50M, 50C and 50K, so as to form a toner image on the photoconductor 51.

The primary transfer device 62 transfers the toner image formed on the photoconductor 51 onto the intermediate transfer belt 61 described later.

The cleaner 55 removes remaining toner or the like on the photoconductor 51 after the transfer is performed, from the photoconductor 51.

Here, in the image forming apparatus 1 of the present exemplary embodiment, a single module including the photoconductor 51, the charger 52, and the cleaner 55 is provided in each of the image forming units 50Y, 50M, 50C and 50K. Herein, this module is referred to as a photoconductor module. The photoconductor module is attachably and detachably installed at an apparatus housing (not illustrated) which is a framework of the image forming apparatus 1.

In addition, the exposure device 53 also forms a single module for each of the image forming units 50Y, 50M, 50C and 50K. Herein, this module is referred to as the exposure module.

Further, the developing device 54 also forms a single module for each of the image forming units 50Y, 50M, 50C and 50K. Herein, this module is referred to as a developing module. The exposure module and the developing module are also respectively attachably and detachably installed at the apparatus housing of the image forming apparatus 1.

The intermediate transfer unit 60 is proved over the four image forming units 50. In addition, the intermediate transfer unit 60 is provided with the intermediate transfer belt 61. The intermediate transfer belt 61 is supported by plural rolls such as a driving roll 63*a*, a following roll 63*b*, and a tension roll 63*c*. Further, the intermediate transfer belt 61 is driven by the driving roll 63*a* and is moved in a circulation manner in an arrow B direction on a circulation path including a path along the four photoconductors 51 forming the four image forming units 50Y, 50M, 50C and 50K.

The toner images of the respective photoconductors 51 are transferred onto the intermediate transfer belt 61 so as to sequentially overlap each other due to an operation of the primary transfer device 62. In addition, the toner images transferred onto the intermediate transfer belt 61 is transported to a secondary transfer position T2 by the intermediate transfer belt 61. A secondary transfer device 71 is provided at the secondary transfer position T2, and the toner images on the intermediate transfer belt 61 is transferred onto a paper sheet P which is transported to the secondary transfer position T2, due to an operation of the secondary transfer device 71. The transport of the paper sheet P will be described later. Toner and the like which remain on the intermediate transfer belt 61 after the toner images are transferred onto the paper sheet P are removed from the intermediate transfer belt 61 by a cleaner 64.

Here, the printer 20 has a monochrome mode in which a monochrome image is printed on the paper sheet P by using only the image forming unit 50K which forms a toner image with the black (K) toner and is located at one end (the leftmost end of FIG. 2) of the arrangement, and a color mode in which a color image is printed on the paper sheet P by using the four image forming units 50Y, 50M, 50C and 50K. The intermediate transfer belt 61 changes its circulation movement path so as to be moved while coming into contact with the four photoconductors 51 constituting the four image forming units 50Y, 50M, 50C and 50K in the color mode, and to be moved while coming into contact with only the photoconductor 51K of the image forming unit 50K located one end (the leftmost end of FIG. 2) of the arrangement and being separated from the photoconductors 51Y, 51M and 51C of all the other image forming units 50Y, 50M and 50C in the monochrome mode. In the monochrome mode, it is possible to save power or lengthen the lifetime of the components by stopping operations of all the other image forming units 50Y, 50M and 50C excluding the image forming unit 50K.

Toner cartridges 23K, 23C, 23M and 23Y storing toner having the respective colors are provided over the intermediate transfer unit 60. If the toner in the developing device 54 is consumed due to development, the developing device 54 is replenished with toner from the toner cartridges 23 K, 23C, 23M and 23Y each of which stores the toner having a corresponding color. The toner cartridges 23 K, 23C, 23M and 23Y are attachably and detachably constituted, and are extracted when empty, and a new toner cartridge 23 is installed.

In addition, the paper tray 21 is provided on a lower side of the printer 20. The paper sheets P on which printing is not performed are accommodated in the paper tray 21 in a stacked manner. The paper tray 21 is constituted to be freely drawn in order to replenish or exchange paper sheets.

A single paper sheet P is extracted from the paper tray 21 by a pickup roll 22*p*, and is transported to timing adjustment rolls 24 in an arrow C direction along a transport path 201 by transport rolls 23. The paper sheet P which is transported to the timing adjustment rolls 24 is sent to the secondary transfer position so as to arrive at the secondary transfer position T2 by the timing adjustment rolls 24 in accordance with a timing at which the toner image on the intermediate transfer belt 61 arrives at the secondary transfer position T2. The toner image is transferred from the intermediate transfer belt 61 onto the paper sheet P sent by the timing adjustment rolls 24 at the secondary transfer position T2 due to an operation of the secondary transfer device 71. The paper sheet P onto which the toner image is transferred is further transported in an arrow D direction and passes through a fixing device 72. The toner image on the paper sheet P is heated and pressurized so as to be fixed to the paper sheet P by the fixing device 72. Accordingly, an image formed by the fixed toner image is printed on the paper sheet P. The paper sheet to which the toner image is fixed by the fixing device 72 is further transported by transport rolls 25 so as to be sent onto the paper discharge tray 22 by paper discharge rolls 26.

In addition, the printer 20 has a duplex print mode in which images are printed on both sides of the paper sheet P. In the duplex print mode, an image is printed on a first surface of the paper sheet P as mentioned above, and then the paper sheet P of which the images are printed on the first surface is sent halfway toward the paper discharge tray 22 by the paper discharge rolls 26. Further, the paper discharge rolls 26 reverse their rotation directions so as to draw back the paper sheet P which is sent halfway on the paper discharge tray 22.

The paper sheet P which is drawn back due to the reverse rotation of the paper discharge rolls 26 is transported along a transport path 202 in a direction indicated by the arrow G by transport rolls 27 this time, and arrives at the timing adjustment rolls 24 again. At this time, the front surface and rear surface of the paper sheet P are reversed to the time when the image is printed on the first surface. After the paper sheet P arrives at the timing adjustment rolls 24 again, an image is printed on a second surface this time in the same manner as described above. Accordingly, the paper sheet P of which the images are printed on both sides is sent onto the paper discharge tray 22 by the paper discharge rolls 26 this time.

In addition, the printer 20 is provided with an input tray 28. When a paper sheet is placed on the input tray 28, and the start button 32 is pressed, the paper sheet on the input tray 28 is transported along a transport path 203 in an arrow H direction by transport rolls 29, and arrives at the timing adjustment rolls 24. The subsequent printing operation is the same as a printing operation on the paper sheet P extracted from the paper tray 21.

Next, the structure of the frame body of the image forming apparatus 1 shown in FIGS. 1 and 2 will be described.

Figure 3:
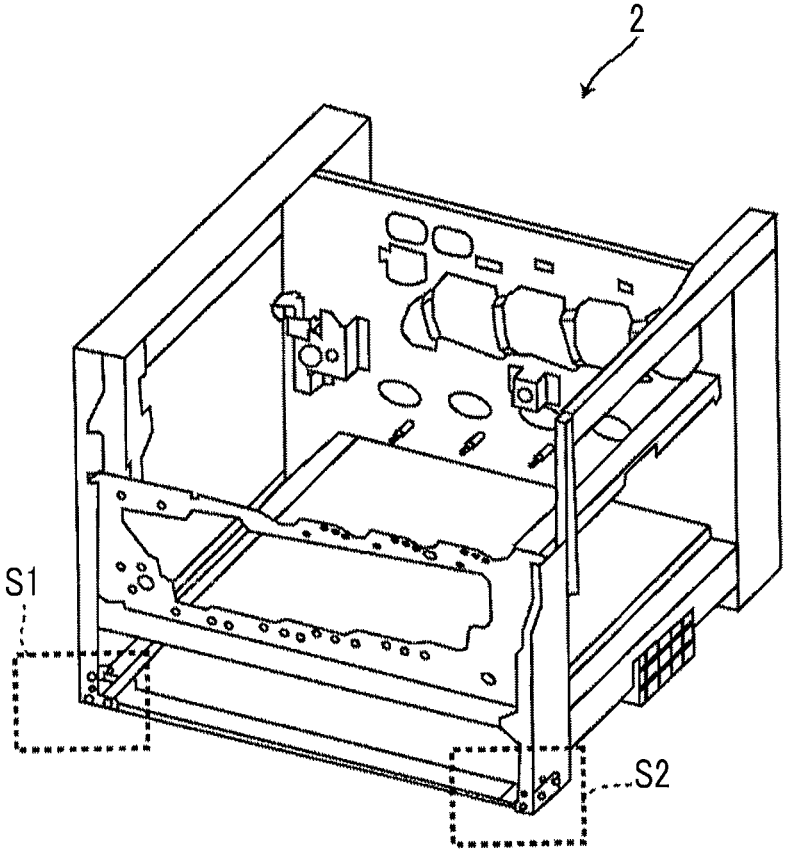
FIG. 3 is a perspective view when a frame body of a printer in the image forming apparatus shown in FIGS. 1 and 2 is viewed from an inclined front side.
Figure 4:
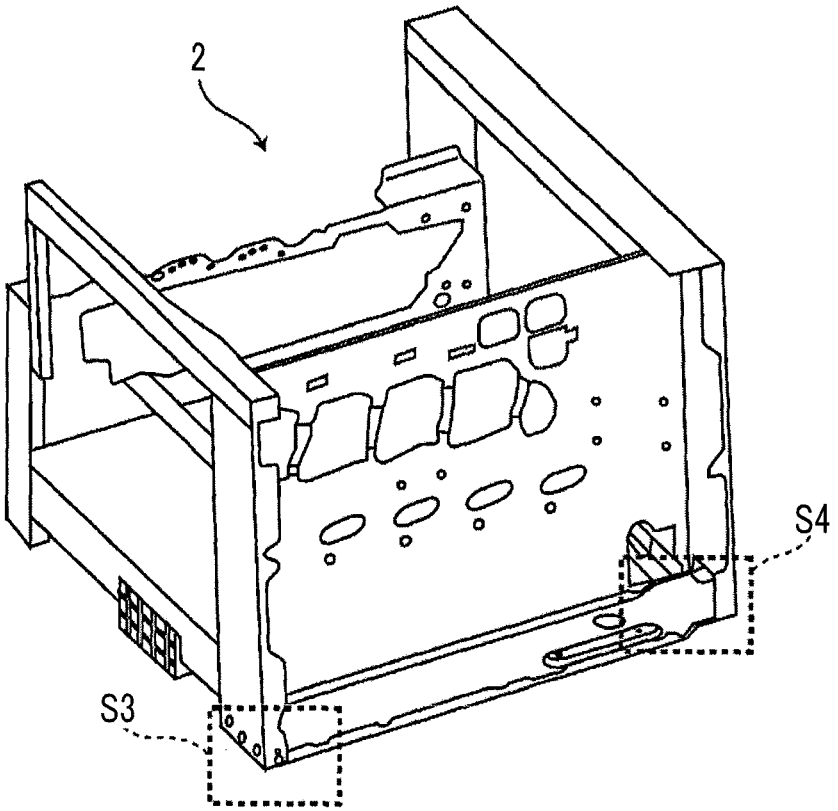
FIG. 4 is a perspective view when the frame body of the printer in the image forming apparatus shown in FIGS. 1 and 2 is viewed from an inclined rear side.

FIGS. 3 and 4 are perspective views when the frame body of the printer 20 in the image forming apparatus shown in FIGS. 1 and 2 is respectively viewed from the inclined front side and the inclined rear side.

Components of the printer 20 are incorporated into the frame body. In addition, the scanner 10 is mounted so as to be placed on the frame body.

A frame body 2 shown in FIGS. 3 and 4 has a complicated shape since various parts are mounted in the inner portion of the frame body 2. However, characteristics portions in the present exemplary embodiment are the structures of four corners enclosed by dotted lines.

When the image forming apparatus 1 shown in FIGS. 1 and 2 is placed on a floor, in the frame body 2 in the present exemplary embodiment, a bottom surface which faces the floor and is extended has a substantially rectangular shape. In addition, at least one corner (all four corners in the present exemplary embodiment) on the bottom surface adopts a frame body structure described below. Hereinafter, the frame body structures of four corners will be sequentially described.

Figure 5:
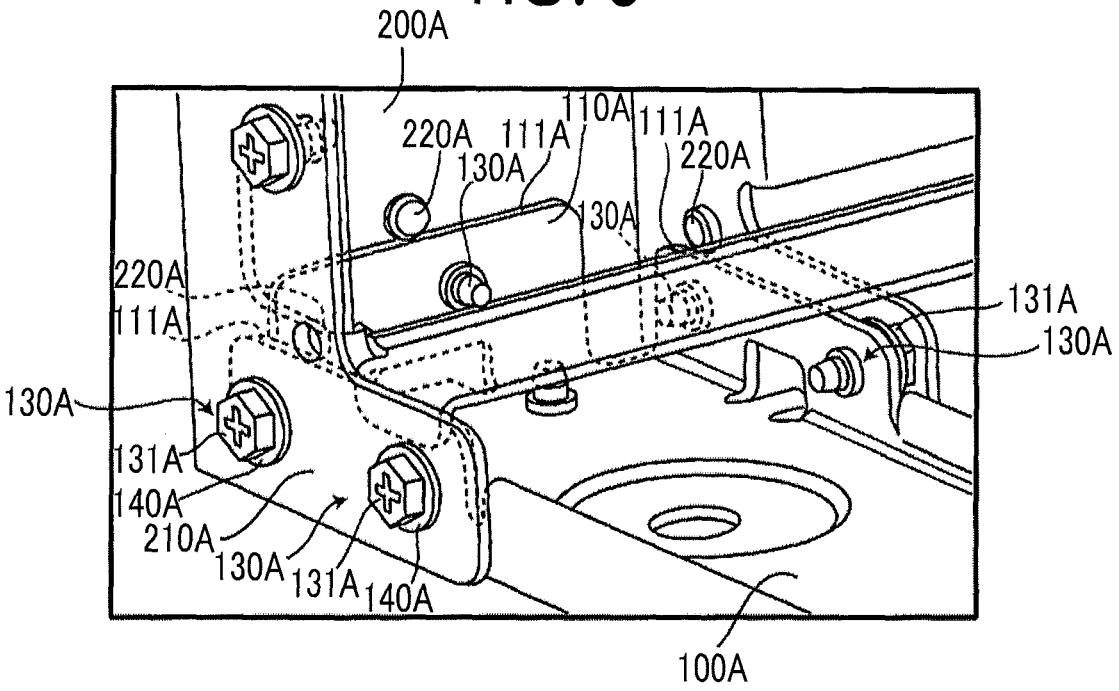
FIG. 5 is an enlarged perspective view of a square S1 portion shown by a dotted line in FIG. 3.

FIG. 5 is an enlarged perspective view of a square S1 portion shown by the dotted lines in FIG. 3.

Here, a first member 100A and a second member 200A are shown. The first member 100A is a member which configures a portion of the substantially rectangular bottom surface extending along the floor when the frame body 2 shown in FIGS. 3 and 4, that is, the image forming apparatus 1 shown in FIGS. 1 and 2 is placed on the floor. The first member 100A includes a side end 110A which is bent in a direction separated from the floor and is raised. In addition, the second member 200A is a member in which an inner surface of a lower end 210A of the second member contacts an outer surface of the side end 110A of the first member 100A and is raised over the side end 110A. The side end 110A of the first member 100A and the lower end 210A of the second member 200A are screwed by screws 130A and are connected to each other. Here, in the screwing, the screwing is performed from the second member 200A side so that a head 131A of the screw 130A reaches the second member 200A side positioned at the outside of the frame body 2 (refer to FIGS. 3 and 4) while interposing a washer 140A. An embossing 220A, which protrudes immediately above an upper end edge 111A of the raised side end 110A of the first member 100A and is an example of a protrusion, is formed on the second member 200A.

Figure 6:
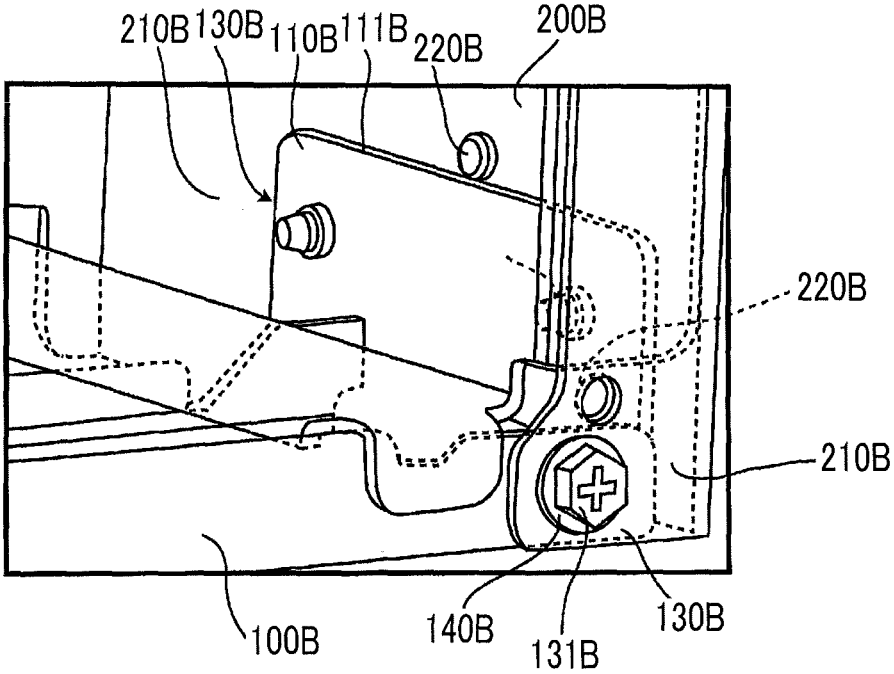
FIG. 6 is an enlarged perspective view of a square S2 portion shown by a dotted line in FIG. 3.

FIG. 6 is an enlarged perspective view of a square S2 portion shown by the dotted lines in FIG. 3.

Here, similar to FIG. 5, a first member 100B and a second member 200B are shown.

Here, as understood from FIG. 3, the first member 100A in FIG. 5 and the first member 100B in FIG. 6 are one member integrally connected. However, here, since the frame body structure for each portion will be described, regardless of whether the portion is one member or a separate member, the descriptions are continued. This is similarly applied to FIGS. 7 and 8 described below.

The first member 100B in FIG. 6 is a member which configures a portion of the substantially rectangular bottom surface extending along the floor when the frame body 2 shown in FIGS. 3 and 4, that is, the image forming apparatus 1 shown in FIGS. 1 and 2, is placed on the floor. The first member 100B includes a side end 110B which is bent in a direction separated from the floor and is raised. In addition, the second member 200B is a member in which an inner surface of a lower end 210B of the second member contacts an outer surface of the side end 110B of the first member 100B and is raised over the side end 110B. The side end 110B of the first member 100B and the lower end 210B of the second member 200B are screwed by screws 130B. Here, in the screwing, the screwing is performed from the second member 200B side so that a head 131B of the screw 130B reaches the second member 200B side positioned on the outside of the frame body 2 (refer to FIGS. 3 and 4) while interposing a washer 140B. In addition, an embossing 220B, which protrudes immediately above an upper end edge 111B of the raised side end 110B of the first member 100B, is formed on the second member 200B.

Figure 7:
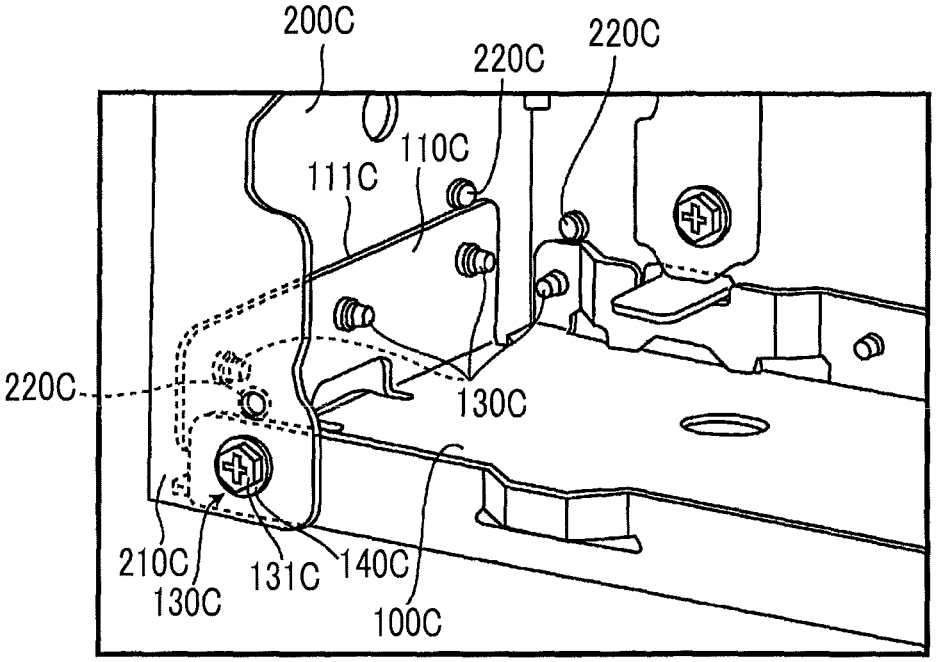
FIG. 7 is an enlarged perspective view of a square S3 portion shown by a dotted line in FIG. 4.

FIG. 7 is an enlarged perspective view of a square S3 portion shown by the dotted lines in FIG. 4.

Here also, similar to FIGS. 5 and 6, a first member 100C and a second member 200C are shown. The first member 100C is a member which configures a portion of a substantially rectangular bottom surface. The first member 100C includes a side end 110C which is bent in a direction separated from the floor and is raised. In addition, the second member 200C is a member in which an inner surface of a lower end 210C of the second member contacts an outer surface of the side end 110C of the first member 100C and is raised over the side end 110C. The side end 110C of the first member 100C and the lower end 210C of the second member 200C are screwed by screws 130C. Here also, in the screwing, the screwing is performed from the second member 200C side so that a head 131C of the screw 130C reaches the second member 200C side positioned at the outside of the frame body 2 (refer to FIGS. 3 and 4) while interposing a washer 140C. In addition, an embossing 220C, which protrudes immediately above an upper end edge 111C of the raised side end 110C of the first member 100C, is formed on the second member 200C.

Figure 8:
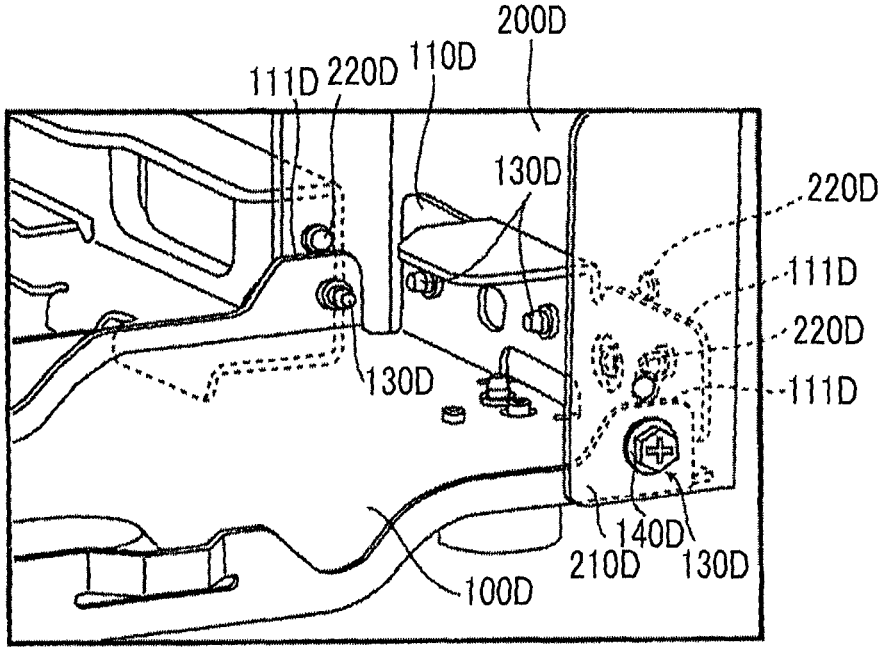
FIG. 8 is an enlarged perspective view of a square S4 portion shown by a dotted line in FIG. 4.

FIG. 8 is an enlarged perspective view of a square S4 portion shown by the dotted lines in FIG. 4.

Here also, similar to FIGS. 5 to 7, a first member 100D and a second member 200D are shown. The first member 100D is a member which configures a portion of the substantially rectangular bottom surface. The first member 100D includes a side end 110D, which is bent in a direction separated from the floor and is raised, on the left side of FIG. 8. In addition, the second member 200D is a member in which an inner surface of a lower end 210D of the second member contacts an outer surface of the side end 110D of the first member 100D and is raised over the side end 110D. The side end 110D of the first member 100D and the lower end 210D of the second member 200D are screwed by screws 130D. Here also, in the screwing, the screwing is performed from the second member 200D side so that a head 131D of the screw 130D reaches the second member 200D side positioned on the outside of the frame body 2 (refer to FIGS. 3 and 4) while interposing a washer 140D. An embossing 220D, which protrudes immediately above an upper end edge 111D of the raised side end 110D of the first member 100D, is formed on the second member 200D.

Figure 9:
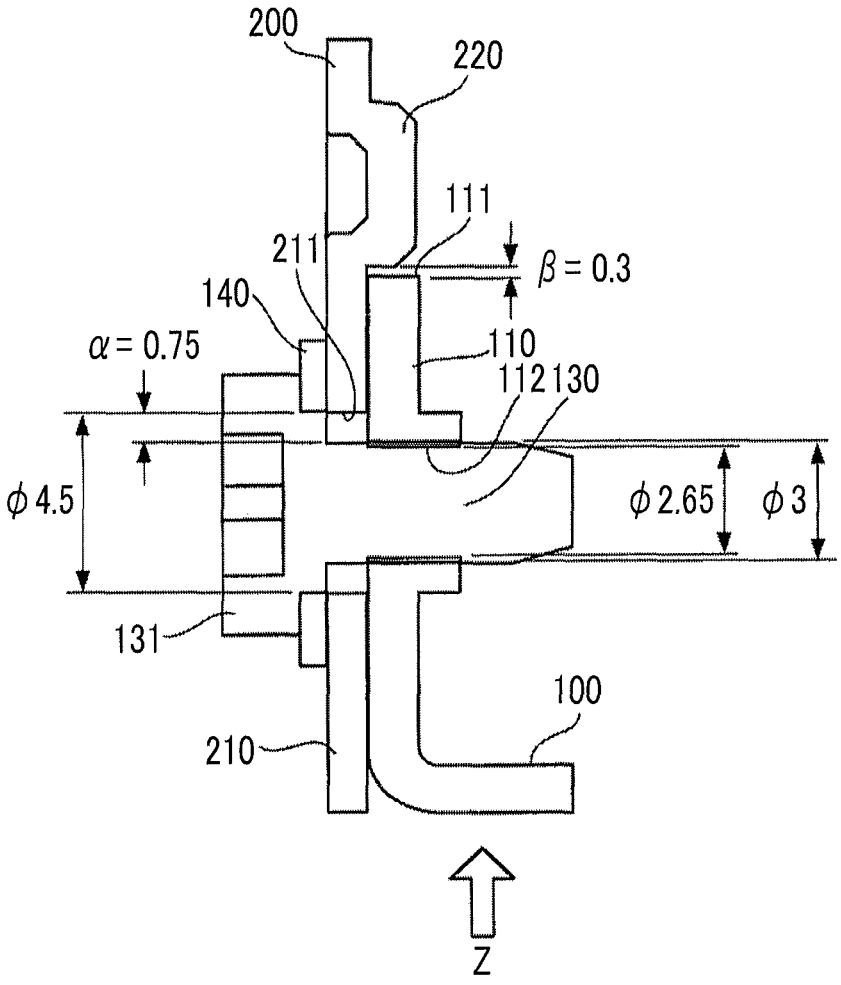
FIG. 9 is an enlarged cross-sectional view of a screw portion between a first member and a second member.

FIG. 9 is an enlarged cross-sectional view of the screw portion between the first member and the second member. FIG. 9 is common to the frame body structures in the four corners shown in FIGS. 5 to 8, and reference numerals, in which "A" to "D" are omitted from the reference numerals assigned to FIGS. 5 to 8, are assigned so as to be shown.

A prepared screw hole 112 having $\phi 2.6$ is formed on a side end 110 of a first member 100, a screw 130 having $\phi 3.0$ is screwed to the prepared screw hole 112, and thus, the prepared screw hole 112 becomes a screw hole.

In addition, a hole 211 having $\phi 4.5$ is formed on a lower end 210 of a second member 200.

The screw 130 is inserted into the hole 211 from the second member 200 side and is screwed to the prepared screw hole 112, and thus, the first member 100 is screwed to the second member 200.

According to the dimensions of the hole 211 and the screw 130, a gap $\alpha$ between the hole 211 and the screw 130 formed on the lower end 210 of the second member 200 satisfies that $\alpha$=0.75 mm.

Moreover, an embossing 220, which protrudes to the first member 100 side immediately above an upper end edge 111 of the raised side end 110 of the first member 100, is formed on the second member 200. A gap $\beta$ between the upper end edge 111 of the side end 110 and the embossing 220 satisfies that $\beta$=0.3 mm.

Here, when the gap $\beta$ and the gap $\alpha$ between the hole 211 and the screw 130 are compared to each other, $\alpha>\beta$ is satisfied. That is, it is considered that impact is applied to the first member 100 in a push-up direction shown by an arrow Z, and thus, the first member 100 is deviated in the push-up direction with respect to the second member by the impact. The impact in the push-up direction is assumed as impact which may be applied during transport of the frame body 2 shown in FIGS. 3 and 4, that is, the image forming apparatus 1 shown in FIGS. 1 and 2.

Figure 10:
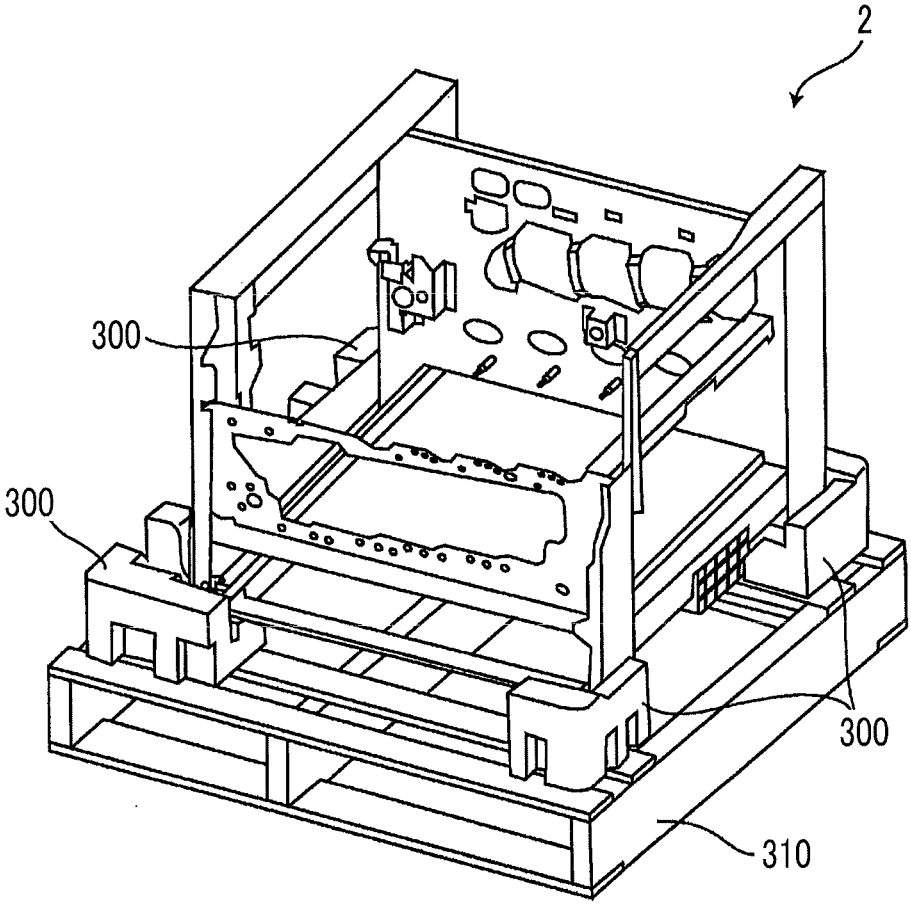
FIG. 10 is a view showing an aspect at the time of transport.

FIG. 10 is a view showing an aspect during the transport.

Here, in order to easily illustrate a relationship between the frame body 2 and a transport tool, only the frame body 2 is shown to be transported. However, in actuality, the image forming apparatus 1 shown in FIG. 1 becomes a target of the transport.

Figure 11:
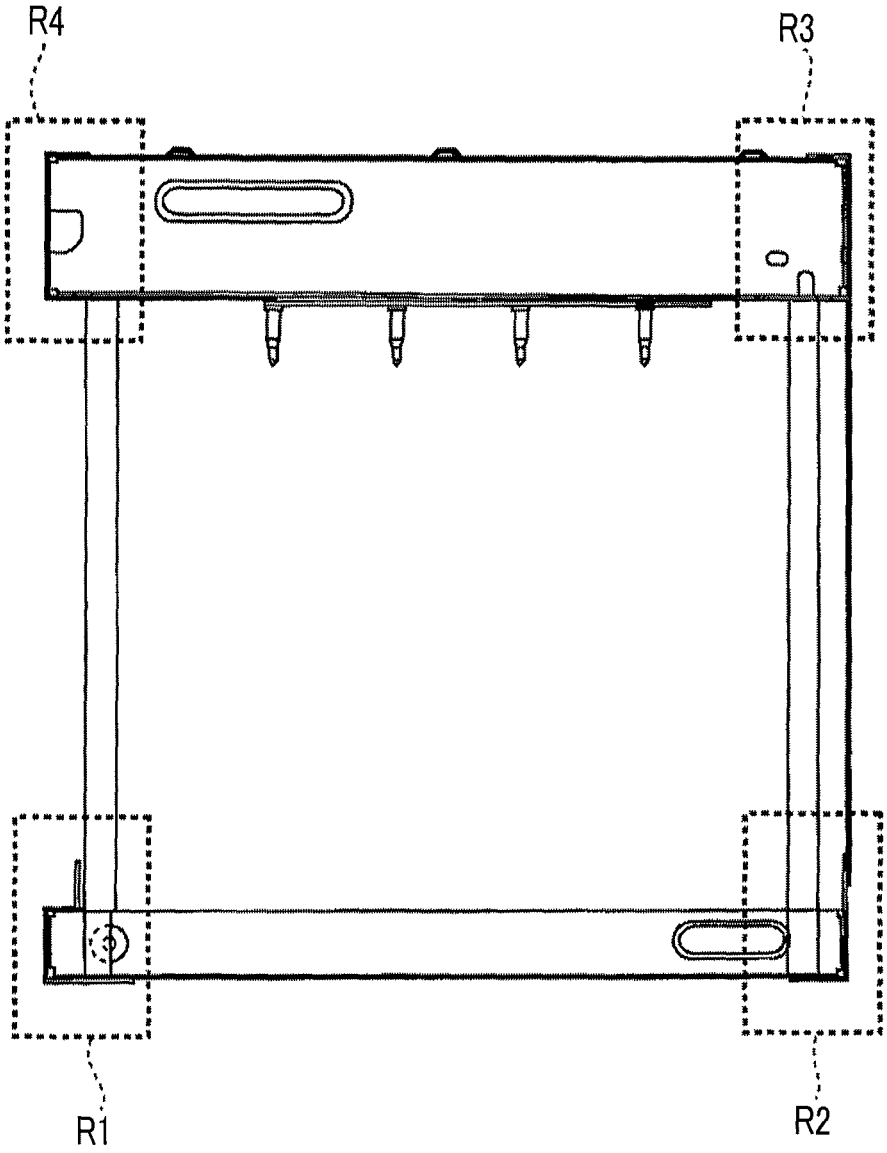
FIG. 11 is a plan view of the frame body.

In addition, FIG. 11 is a plan view of the frame body.

As shown in FIG. 10, a packing material 300 comes into contact with packing material receiving portions R1 to R4 enclosed by dotted lines of FIG. 11 at four corners of the bottom surface of the frame body 2 (image forming apparatus 1). In addition, the entirety including the packing material 300 is placed on a wooden frame 310 and is loaded on and unloaded from a deck of a truck by a fork lift (not shown) or the like. During the transport, by roughly placing or carelessly dropping the entirety, the entirety may receive the impact in the push-up direction shown by the arrow Z in FIG. 9.

Return to FIG. 9, and the descriptions will be continued.

During a normal time, the second member 200 and the first member 100 are connected to each other in a state where the gap $\beta$ between the upper end edge 111 of the side end 110 and the embossing 220 is maintained by the fastening force of the screw 130. However, if the push-up impact is applied as described above during the transport or the like, before the screw 130 abuts the hole 211 from the relationship of $\alpha>\beta$, the upper end edge 111 of the side end 110 abuts the embossing 220. In this way, the embossing 220 receives the impact. Accordingly, since the embossing 220 receives the impact, the damage of the screw 130 may be prevented.

However, the embossing may rarely receive the impact exceeding the impact which may be received by the embossing 220. When the embossing 220 receives the strong impact, the embossing 220 is deformed or is torn off. When the strong impact is applied, the frame body itself of the image forming apparatus 1 is deformed, and in most cases, the image forming apparatus 1 is not normally operated.

When the image forming apparatus 1 is recovered due to the deformation, the operation failure, or the like, it is determined whether or not the reasons of the deformation, the operation failure, or the like are the above-described impact by checking the embossing 220.

Moreover, in the present exemplary embodiment, the frame body structures including the screwing and the embossing are provided on four corners shown by rectangular shapes S1 to S4 of dotted lines in FIGS. 3 and 4. Accordingly, by checking that any embossing is deformed or is torn off due to the impact, it may be understood that the impact is likely applied to any corner during the transport, which may be used for measures.

Moreover, here, the example is described in which the frame body structure described with reference to FIGS. 5 to 9 is applied to the frame body 2 (refer to FIGS. 3 and 4) of the image forming apparatus 1 shown in FIGS. 1 and 2. However, the frame body structure of the present invention is not applied to only the image forming apparatus 1 and is generally applied to a frame body of an apparatus. Particularly, when the frame body structure is applied to the frame body of the apparatus which is transported like in the aspect exemplified in FIG. 10, great effectiveness may be achieved.

In addition, in the present exemplary embodiment, the example is described in which the second member 200 and the first member 100 are connected to each other by the screws 130. However, as the aspect of the connection, only the screw is not applied, and a method in which a pin is pressed into a hole or other connection methods such as bonding or welding may be used. For example, also in a case where other connection methods such as bonding or welding are adopted, when the first member 100 receives the impact in the push-up direction shown by the arrow Z in FIG. 9 and is deformed, the first member 100 and the embossing 220 are in contact with each other, and thus, the deformation of the first member may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A frame body structure comprising: a first member that includes a side wall extending in a direction away from a floor when the frame body structure is placed on the floor and is provided along the floor; and a second member that (i) includes a lower end portion contacting the side wall, (ii) extends above the side wall, and (iii) includes a protrusion protruding over an upper end edge of the side wall, the upper end edge of the side wall being an uppermost surface of the first member, wherein the first member and the second member are combined with each other, wherein the side wall and the lower end portion are connected to each other by a connection unit, wherein the side wall is provided with a first hole into which the connection unit is inserted, wherein the lower end portion is provided with a second hole having a diameter in which contact of the connection unit inserted into the first hole with respect to an inner wall surface is prevented even when the connection unit penetrates the first hole and the upper end edge of the side wall contacts the protrusion, and wherein a gap between the upper end edge of the side wall of the first member and the protrusion is smaller than a gap between the second hole and the connection unit.

2. An apparatus frame body comprising the frame body structure of claim 1, wherein the apparatus frame body further includes a bottom wall with a bottom surface that faces the floor and extends in a same direction as the floor when the frame body is placed on the floor, the frame body structure being located at at least one corner area of the bottom surface.

3. The apparatus frame body according to claim 2, wherein the bottom surface has a substantially rectangular shape having four corner areas, and the frame body structure is located at each of the four corner areas of the rectangular shape.

4. An image forming apparatus, comprising:

the apparatus frame body according to claim 2; and an image forming portion that forms an image on a sheet and is supported by the apparatus frame body.

5. A frame body structure comprising: a first member that includes a side wall extending in a direction away from a floor when the frame body structure is placed on the floor and is provided along the floor; and a second member that (i) includes a lower end portion contacting the side wall, (ii) extends above the side wall, (iii) does not extend below the side wall, and (iv) includes a protrusion protruding over an upper end edge of the side wall, wherein the first member and the second member are combined with each other, wherein the side wall and the lower end portion are connected to each other by a connection unit, wherein the side wall is provided with a first hole into which the connection unit is inserted, wherein the lower end portion is provided with a second hole having a diameter in which contact of the connection unit inserted into the first hole with respect to an inner wall surface is prevented even when the connection unit penetrates the first hole and the upper end edge of the side wall contacts the protrusion, and wherein a gap between the upper end edge of the side wall of the first member and the protrusion is smaller than a gap between the second hole and the connection unit.

6. A frame body structure comprising: a first member that includes a side wall extending in a direction away from a floor when the frame body structure is placed on the floor and is provided along the floor; and a second member that (i) abuts the side wall of the first member, (ii) includes a lower end portion contacting the side wall, (iii) extends above the side wall, and (iv) includes a protrusion protruding over an upper end edge of the side wall, the protrusion jutting out from an abutting surface of the second member that abuts a surface of the first member such that the protrusion includes a first surface portion and second surface portion that extend away from the abutting surface and terminate at a free end portion, the first surface portion facing the upper end edge of the side wall and the second surface portion facing away from the upper end edge of the side wall, wherein the first member and the second member are combined with each other, wherein the side wall and the lower end portion are connected to each other by a connection unit, wherein the side wall is provided with a first hole into which the connection unit is inserted, wherein the lower end portion is provided with a second hole having a diameter in which contact of the connection unit inserted into the first hole with respect to an inner wall surface is prevented even when the connection unit penetrates the first hole and the upper end edge of the side wall contacts the protrusion, and wherein a gap between the upper end edge of the side wall of the first member and the protrusion is smaller than a gap between the second hole and the connection unit.

* * * * *